US008621900B2

(12) United States Patent
Wu et al.

(10) Patent No.: US 8,621,900 B2
(45) Date of Patent: Jan. 7, 2014

(54) ELECTRIC DOOR LOCK

(75) Inventors: Rong-Faa Wu, Chiayi (TW); Tong-Yi Ho, Minxiong Township, Chiayi County (TW); Kun-Chen Tsai, Chiayi (TW); Chen-Ming Lin, Minxiong Township, Chiayi County (TW); Ching-Chuan Kuo, Singang Township, Chiayi County (TW)

(73) Assignee: Tong Lung Metal Industry Co., Ltd., Taipei (TW)

( * ) Notice: Subject to any disclaimer, the term of this patent is extended or adjusted under 35 U.S.C. 154(b) by 291 days.

(21) Appl. No.: 13/091,295

(22) Filed: Apr. 21, 2011

(65) Prior Publication Data

US 2011/0259059 A1 Oct. 27, 2011

(30) Foreign Application Priority Data

Apr. 22, 2010 (TW) ..... 99207301 U
Oct. 15, 2010 (TW) ..... 99219916 U
Nov. 2, 2010 (TW) ..... 99221138 U

(51) Int. Cl.
*E05B 47/06* (2006.01)

(52) U.S. Cl.
USPC ..... 70/280; 70/223; 70/278.7; 70/279.1; 70/432; 292/142; 292/144

(58) Field of Classification Search
USPC ..... 70/280–282, 432, DIG. 59, 279.1, 277, 70/223, 188–190, 149, 472, 278.1, 278.7, 70/422, 278.2, 278.3, 218, 222; 292/142, 292/144, DIG. 27; 192/54.5
See application file for complete search history.

(56) References Cited

U.S. PATENT DOCUMENTS

| | | | | |
|---|---|---|---|---|
| 5,857,365 | A * | 1/1999 | Armstrong | 70/279.1 |
| 6,012,310 | A * | 1/2000 | Hsiao | 70/278.2 |
| 6,517,127 | B1 * | 2/2003 | Lu et al. | 292/144 |
| 7,543,469 | B1 * | 6/2009 | Tseng et al. | 70/472 |
| 7,770,423 | B2 * | 8/2010 | Wu | 70/218 |
| 7,984,631 | B2 * | 7/2011 | Case et al. | 70/278.1 |
| 8,291,733 | B2 * | 10/2012 | Chiou et al. | 70/224 |
| 8,365,561 | B2 * | 2/2013 | Chang | 70/472 |
| 8,490,445 | B2 * | 7/2013 | Chiou et al. | 70/279.1 |
| 2003/0209042 | A1 * | 11/2003 | Yeh et al. | 70/280 |
| 2003/0209043 | A1 * | 11/2003 | Yeh et al. | 70/280 |
| 2007/0169525 | A1 * | 7/2007 | Chang | 70/472 |
| 2009/0211320 | A1 * | 8/2009 | Wu | 70/277 |
| 2011/0185554 | A1 * | 8/2011 | Huang et al. | 29/428 |

* cited by examiner

*Primary Examiner* — Lloyd Gall
(74) *Attorney, Agent, or Firm* — Chun-Ming Shih

(57) ABSTRACT

An electric door lock including: a lock housing; an operating member having a holding part and a shaft part, the shaft part able to be placed in the lock housing, the shaft part connected to the holding part, the holding part defined as a long axis; a cog wheel able to be placed in the lock housing, the cog wheel having at least one bump; a coupling plate installed on the shaft part of the operating member, the coupling plate having at least one bulge and one protruding part, with the protruding part and the long axis of the holding part designed to move in alignment with each other; a motor placed in the lock housing; three sensor switches set separately in the lock housing; operating the motor causing the bump of the cog wheel to rotate and push the bulge of the coupling plate, so that the protruding part of the coupling plate of the electric door lock installed in the required position on a left-hand door or right-hand door, selectively touches the two sensor switches adjacent to each other, so as to reach the correct unlocked position or locked position.

16 Claims, 18 Drawing Sheets

ELECTRIC DOOR LOCK

BACKGROUND OF THE INVENTION

1. Field of the invention

The invention relates to an electric door lock, more particularly to an electric door lock that is operable in manual and electronic modes to lock and unlock, which can be conveniently assembled and secured into position on a left-hand door or a right-hand door.

2. Description of Related Art

The function of a lock is to maintain the security of the house owner's life and property, so, the development of lock design tends to require easy operation and use, but a design that's hard to open for unscrupulous people. In view of current widely used locks, no matter whether the door lock is indoors or outdoors, most of the locks are of a mechanical type using a key to lock and unlock. Such kind of key-controlled door locks, in fact, are inconvenient. Therefore, electric door locks are developing robustly and changing with the times. Due to their internal electronic and mechanical structure, the general electric door lock is assembled and secured into position on a left-hand door or a right-hand door and therefore needs modified settings. Also, electronic control devices cannot correctly recognize whether the dead bolt correctly reaches the unlocked position or locked position. Thus, how to eliminate these above-mentioned shortcomings becomes the motivation of the present invention. In U.S. patent application Publication No. US20070169525, there is disclosed an electric door lock which still has the shortcomings of recognizing whether the dead bolt is in the correct locked or unlocked position, no matter whether the electric door lock is assembled and secured into position on a left-hand door or a right-hand door.

SUMMARY OF THE INVENTION

In view of this, the purpose of this invention is to provide an electric door lock, which can be easily assembled and secured into position on a left-hand door or a right-hand door.

Another purpose of this invention is to provide an electric door lock, which is assembled easily, and can recognize whether the dead bolt correctly reaches the unlocked or locked position.

An electric door lock including: a lock housing; an operating member having a holding part and a shaft part, the shaft part partially disposed in the lock housing, the shaft part connected to the holding part, the holding part defined as a long axis; a cog wheel installed in the lock housing, the cog wheel having at least one bump; a coupling plate set on the operating member, the coupling plate having at least one bulge, one arc part and one protruding part, the arc part set in, and able to rotate in the arc shaped groove; and a motor set in the lock housing; three sensor switches set separately in the lock housing; wherein, the operating the motor causes the cog wheel to rotate and push the bulge of the coupling plate past the bump on the cog wheel, so that the protruding part of the coupling plate of the electric door lock installed in the required position on the left-hand door or right-hand door, selectively touches the two sensor switches adjacent to each other, so as to reach the correct unlocked position or locked position.

Preferably, the electric door lock further comprises a lock sliding cover mechanism and an external cover positioning mechanism, wherein the lock sliding cover mechanism includes a decorative cover, a sliding cover and a flexible element, and the external cover positioning mechanism includes an external cover and an engaging component.

BRIEF DESCRIPTION OF THE DRAWINGS

The invention, as well as its many advantages, may be further understood by the following detailed description and drawings in which.

DETAILED DESCRIPTION OF THE INVENTION

Figure 1:
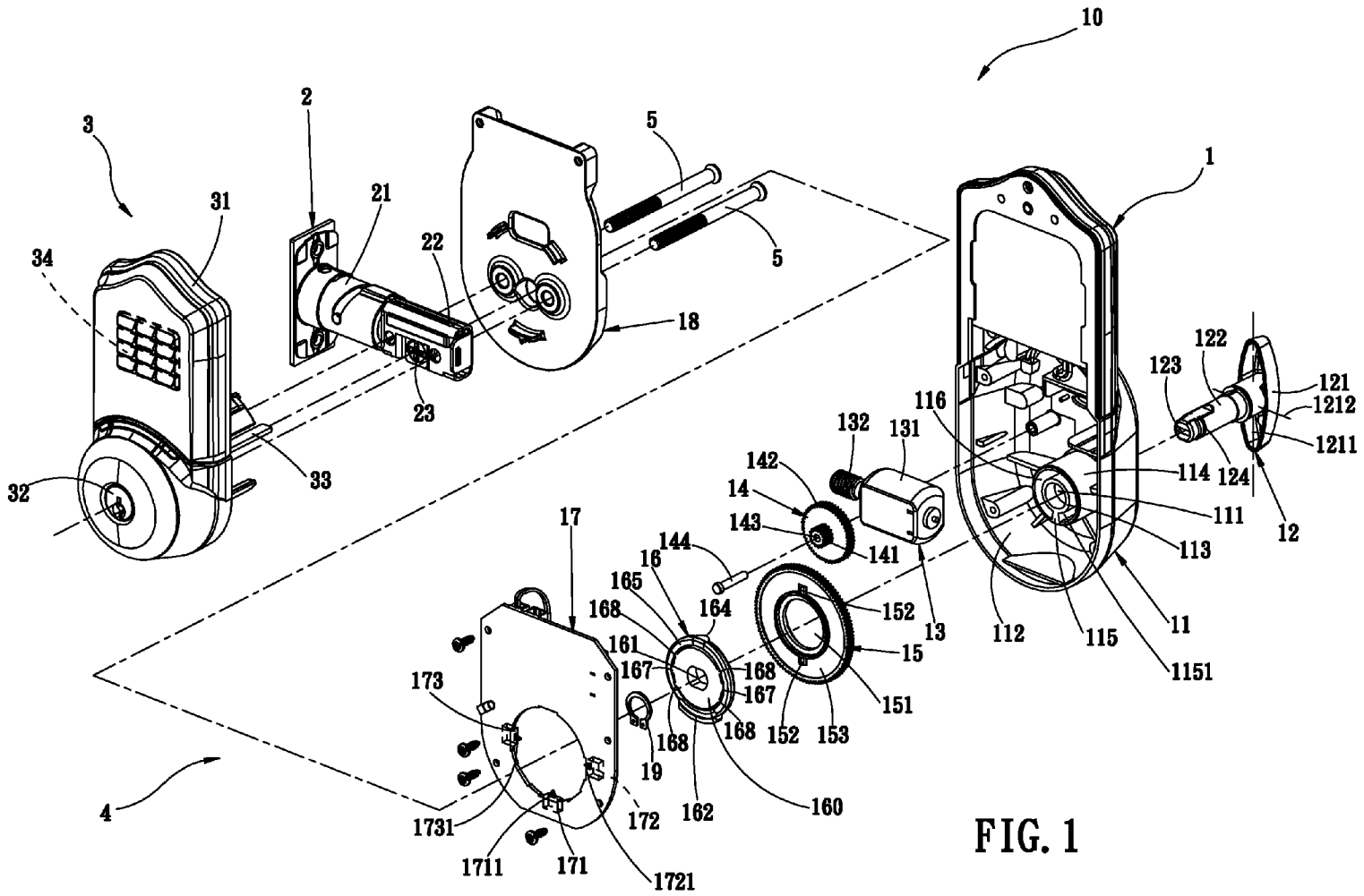
FIG. 1 is an exploded perspective diagram showing the electric door lock of the preferred embodiment of the present invention.

The invention, as well as its many advantages, may be further understood by the following detailed description and drawings in which:

Please refer to FIG. 1 to FIG. 4, which are a preferred embodiment of an electric door lock. The electric door lock 10 can be installed in a door (not shown in the figures), which can be locked or unlocked either by manual or electronic operation. The electric door lock 10 includes: an internal lock housing 1, a dead bolt 2 and an external lock housing 3; the internal lock housing including: a lock housing 11, an operating member 12, an electric driving unit 13, a worm wheel 14, a cog wheel 15, a coupling plate 16, a frame 18 and a first sensor switch 171, a second sensor switch 172, and a third sensor switch 173 being installed in electronic control device 17.

Wherein, in the above-mentioned lock housing 11 is an accommodating space 112, the lock housing 11 having a first flange 113 and a second flange 114. An extension 115 and an arc shaped groove 116 are formed between the first flange 113 and the second flange 114. The blocking surfaces 1151 are formed on both sides of the extension 115. A through-hole 111 is formed inside the first flange 113. And, areas with various sizes are formed in the accommodating space 112 of the lock housing 11 so as to accommodate the above-mentioned components.

The above-mentioned operating member 12 has a shaft part 122 and a holding part 121. The shaft part 122 connects to the holding part 121, the holding part 121 has a long axis 1211 and a short axis 1212, and the long axis 1211 is perpendicular to the short axis 1212. The shaft part 122 can partially penetrate the through-hole 111 of the lock housing 11 and the end of shaft part 122 has a predetermined shape (this invention revealing the circular shaft with two adjacent flat sides cut into the circular shaft). A recess 123 is formed at the axis of the shaft part 122 and a circlip groove 124 is formed close to the end of shaft part 122.

The above-mentioned electric driving unit 13 can be installed in the accommodating space 112 of the lock housing 11. The electric driving unit 13 is a reversible motor 131. A worm shaft 132 is installed at the front of the motor 131.

The worm wheel 14 is made up of a small gear 141 superimposed on a large gear 142 (the worm wheel 14 can be constructed as one unit). The large gear 142 can mesh with the worm shaft 132 of the motor 131 so as to control the speed and be able to change the direction of transmission. A hole 143 is in the center of worm wheel 14, which can accept a dowel pin 144 to pass through, allowing worm wheel 14 to be set in the accommodating space 112 of the lock housing 11, but allowing worm wheel 14 to rotate as necessary.

A cog wheel 15, having cogs which can mesh with the small gear 141 on worm gear 14 to slow the speed of transmission. A center hole 151 is in the center of the cog wheel 15. The cog wheel 15 can be installed on the second flange 114 of the lock housing 11. Two separate bumps 152 are formed on the side 153 of the cog wheel 15. The external shape of the separate bumps 152 is a camber shape.

Figure 3:
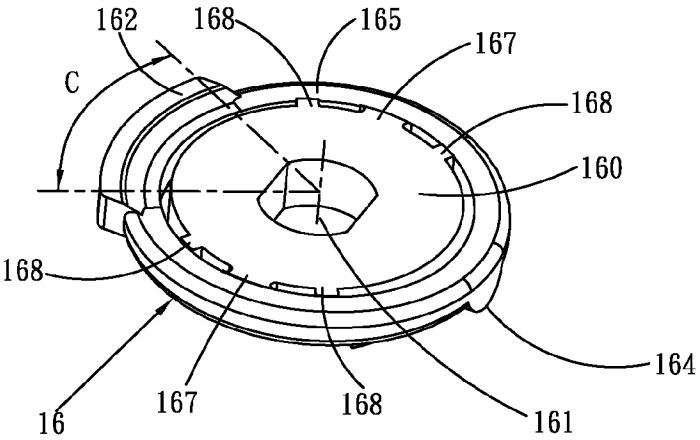
FIG. 3 is a perspective diagram showing the coupling plate of the preferred embodiment of the present invention.
Figure 4:
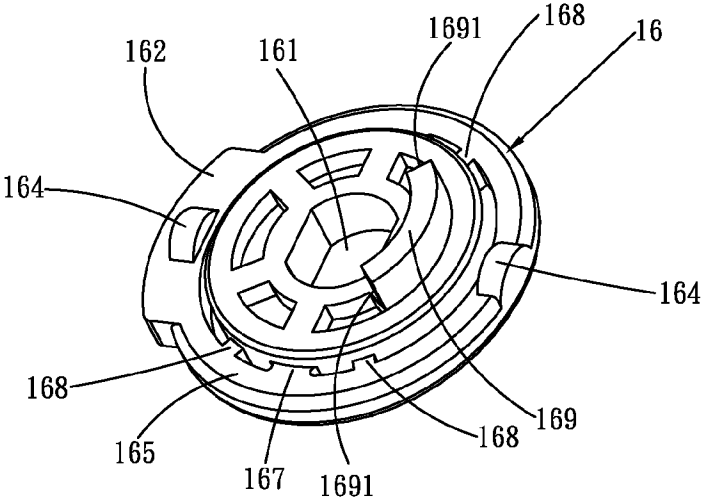
FIG. 4 is another perspective diagram showing the coupling plate of the preferred embodiment of the present invention.

As shown in FIG. 3 and FIG. 4, the coupling plate 16 has a plate 160 and a ringed part 165, the plate 160 and ringed part 165 are connected by two first junctions 167 set on opposite sides of the plate 160 on a diameter line on plate 160, and four separate second junctions 168. The second junctions 168 and first junctions 167 form an angle. A protruding part 162 extends on one side from the outer circumference of the ringed part 165. One side of the ringed part 165 faces side 153 of the cog wheel 15. Two bulges 164 are set apart at an interval and extend from the ringed part 165. The outer shape of the bulges 164 is an arc shape. The two bulges 164 respectively are set approximately perpendicular to the first junctions 167. When the coupling plate 16 is installed on the shaft part 122 of the operating member 12, the protruding part 162 and the long axis 1211 of the holding part 121 of the operating member 12 are designed to rotate in alignment with each other. The plate 160 of the coupling plate 16 has an arc part 169 which extends toward the lock housing 11. The arc part 169 can be installed in the arc shaped groove 116 of the lock housing 11. The respective ends of the arc part 169 form stoppers 1691 so as to limit the turning angle of coupling plate 16 when the coupling plate 16 rotates and the stoppers 1691 come into contact with the blocking surface 1151 of the lock housing 11. A shaped through hole 161 is formed in the center of plate 160 of the coupling plate 16, which has the same cross-sectional shape as the end of the shaft part 122 of the operating member 12 so as to install the coupling plate 16 on the shaft part 122 of the operating member 12, a circlip 19 is installed on the circlip groove 124 to hold coupling plate 16 on the shaft part 122. The coupling plate 16 and the operating member 12 are designed to rotate in alignment with each other and directly affect each other.

The described electronic control device 17, on which is installed control circuitry and chips (not shown in the figures), can be installed in the accommodating space 112 of the lock housing 11. Installed on the electronic control device 17 is the first sensor switch 171, the second sensor switch 172 and the third sensor switch 173 (the sensor switches can be micro switches, limit switches, infrared sensors, etc.), wherein, the first sensor switch 171 and the second sensor switch 172 are set approximately 90 degrees apart, the first sensor switch 171 and the third sensor switch 173 are also set approximately 90 degrees apart in the other direction. The first sensor switch 171 has a touch control part 1711, the second sensor switch 172 has a touch control part 1721, and the third sensor switch 173 has a touch control part 1731. The touch control part 1711 of the first sensor switch 171, the touch control part 1721 of the second sensor switch 172, and the touch control part 1731 of the third sensor switch 173 can selectively be touched by the protruding part 162 on coupling plate 16 and the electronic control device 17 can control the motor 131 to rotate forwards or backwards.

A frame 18 can be installed on the inside side (not shown in the figures) of the door by two bolts 5, said frame 18 is installed and secured on the door together with dead bolt 2, and the external lock housing 3 on the outside side of the door. And the frame 18 can be installed in the accommodating space 112 of the lock housing 11 so as to seal a part of the accommodating space 112 of the lock housing 11.

Accordingly, the external lock housing 3 includes: a decorative cover 31, a cylinder lock 32 and an electronic control component 34 (which can be a keypad component, a fingerprint recognition component, a remote control component . . . and so on, the invention revealing a keypad component), wherein the electronic control component 34 controls the electronic control device 17 through an electronic circuit (not shown in the figures). And the cylinder lock 32 connects to a transmission 33, the transmission 33 is inserted through hole 23 of the driving mechanism 22 of dead bolt 2 and then inserts into recess 123 of the operating member 12, thereby driving dead bolt head 24 of dead bolt 2 to extend out the dead bolt housing 21, or recede into dead bolt housing 21, or any position in between.

Figure 2:
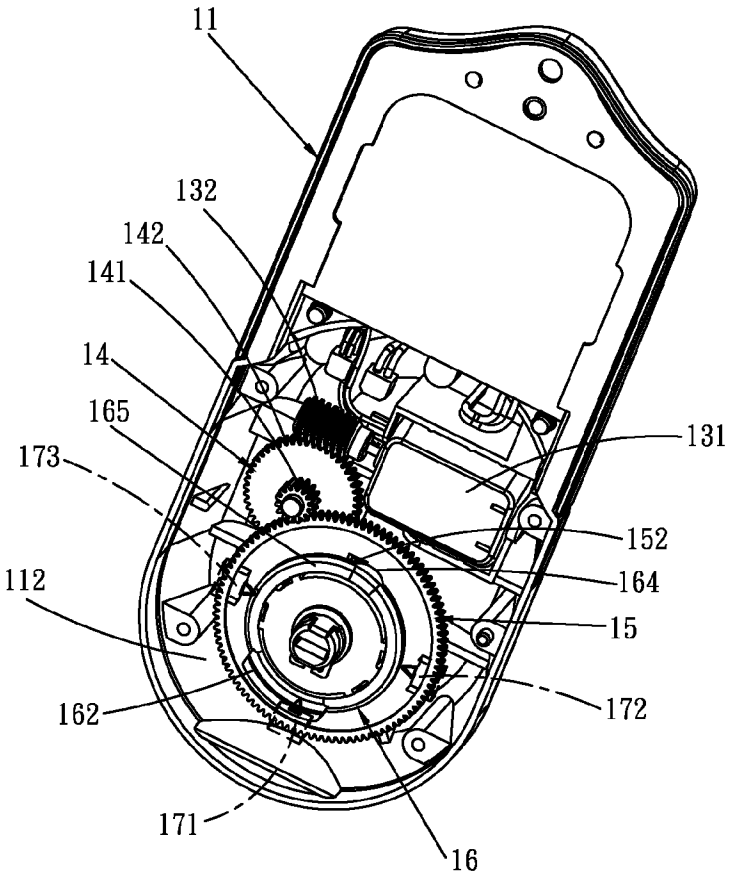
FIG. 2 is an assembly diagram showing the partly internal lock housing of the preferred embodiment of the present invention.
Figure 5:
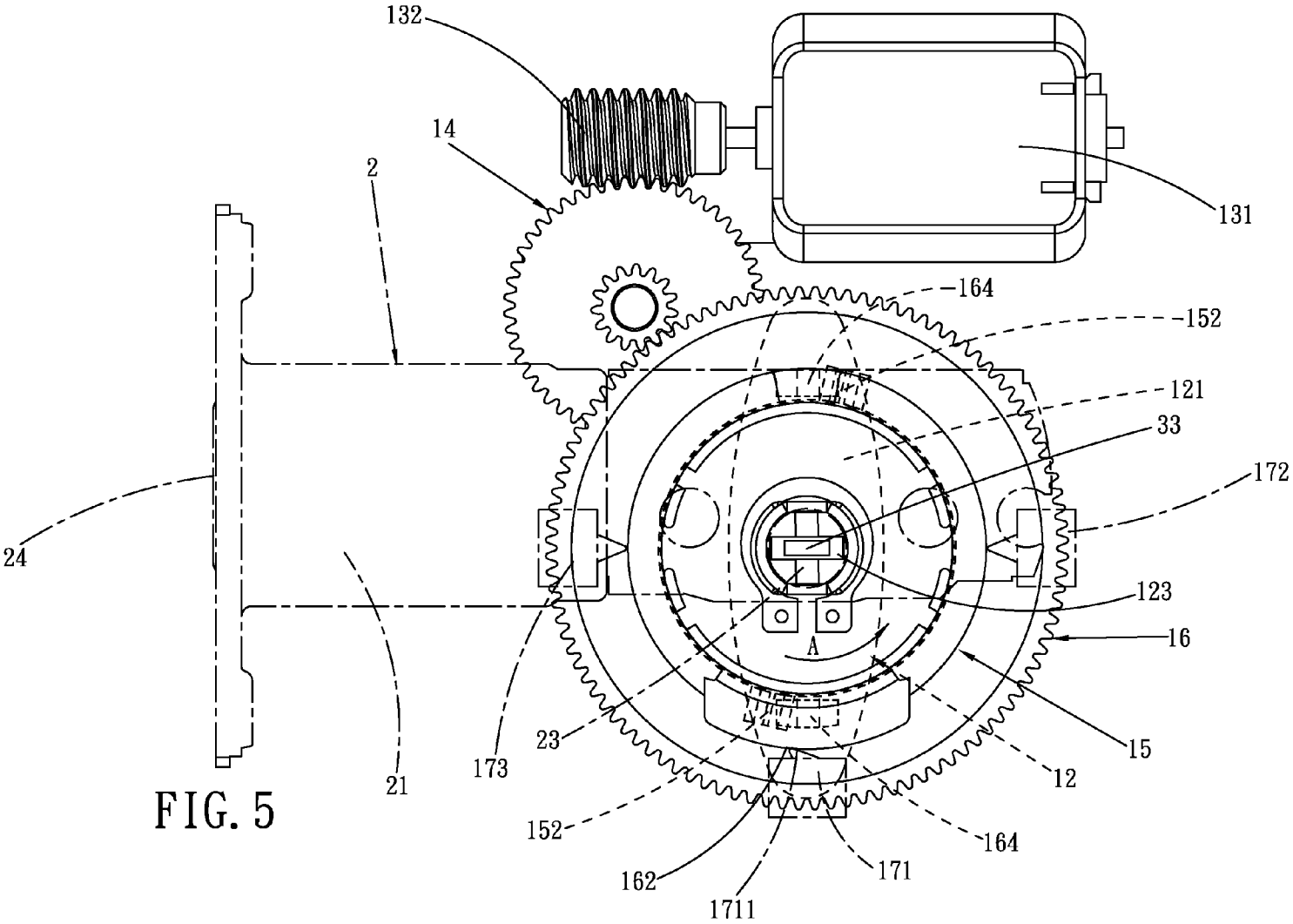
FIG. 5 is a plane schematic diagram partly showing the internal lock housing disposed in position on a right-hand door, which is manually operated to an unlocked position according to the preferred embodiment of the present invention.
Figure 6:
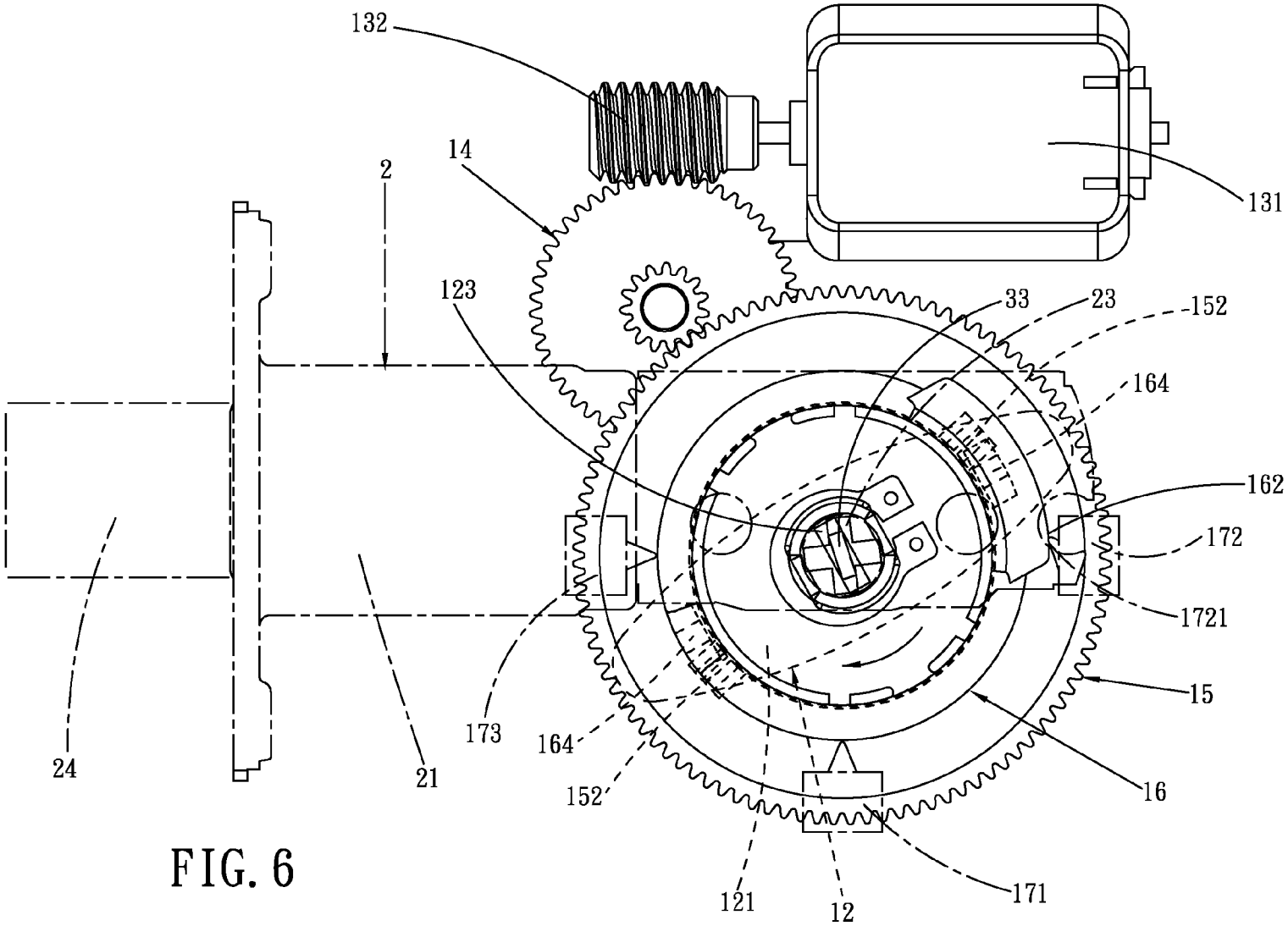
FIG. 6 is a plane schematic diagram partly showing the internal lock housing disposed in position on a right-hand door, which is manually operated to a locked position according to the preferred embodiment of the present invention.

As shown in FIG. 5 to FIG. 6, wherein FIG. 5 shows an unlocked condition, when the electric door lock 10 of the invention is assembled and secured into position on a right-hand door (not shown in the figures), the protruding part 162 of the coupling plate 16 touches on the touch control part 1711 of the first sensor switch 171 (the main purpose of the this action is to relay to the electronic control device 17 that the door is in an unlocked position, the electronic control components 34 therefore are not able to repeat the unlocking action). At this moment, the position of the two bumps 152 on the cog wheel 15 are situated in a clockwise direction and close to the two bulges 164 on coupling plate 16. When the user would like to manually operate the door to a locked position, the user just needs to turn the operating member 12 (as shown in FIG. 1 and FIG. 2) thereby directly driving the coupling plate 16 counterclockwise (as the arrow A in FIG. 5 shows). Since the operating member 12, the transmission shaft 33 and the coupling plate 16 are designed to rotate together, the transmission shaft 33 can drive the driving mechanism 22 of the dead bolt 2 (not shown in the figure), thereby forcing dead bolt head 24 to move out of dead bolt housing 21 and also turning protruding part 162 of the coupling plate 16 to touch on the touch control part 1721 of the second sensor switch 172 (the main purpose of this action is to relay to the electronic device 17 that the door is in a locked position, the electronic components 34 therefore are not able to repeat the locking action). The coupling plate 16 will thus move from the unlocked position shown FIG. 5 to the locked position shown in FIG. 6. It therefore follows that manually turning operating member 12 in the opposite direction described above (not shown in the figure) will move coupling plate 16 to the locked position. Obviously cylinder lock 32 has the same functions as operating member 12, and its use will not be repeated again.

Figure 7:
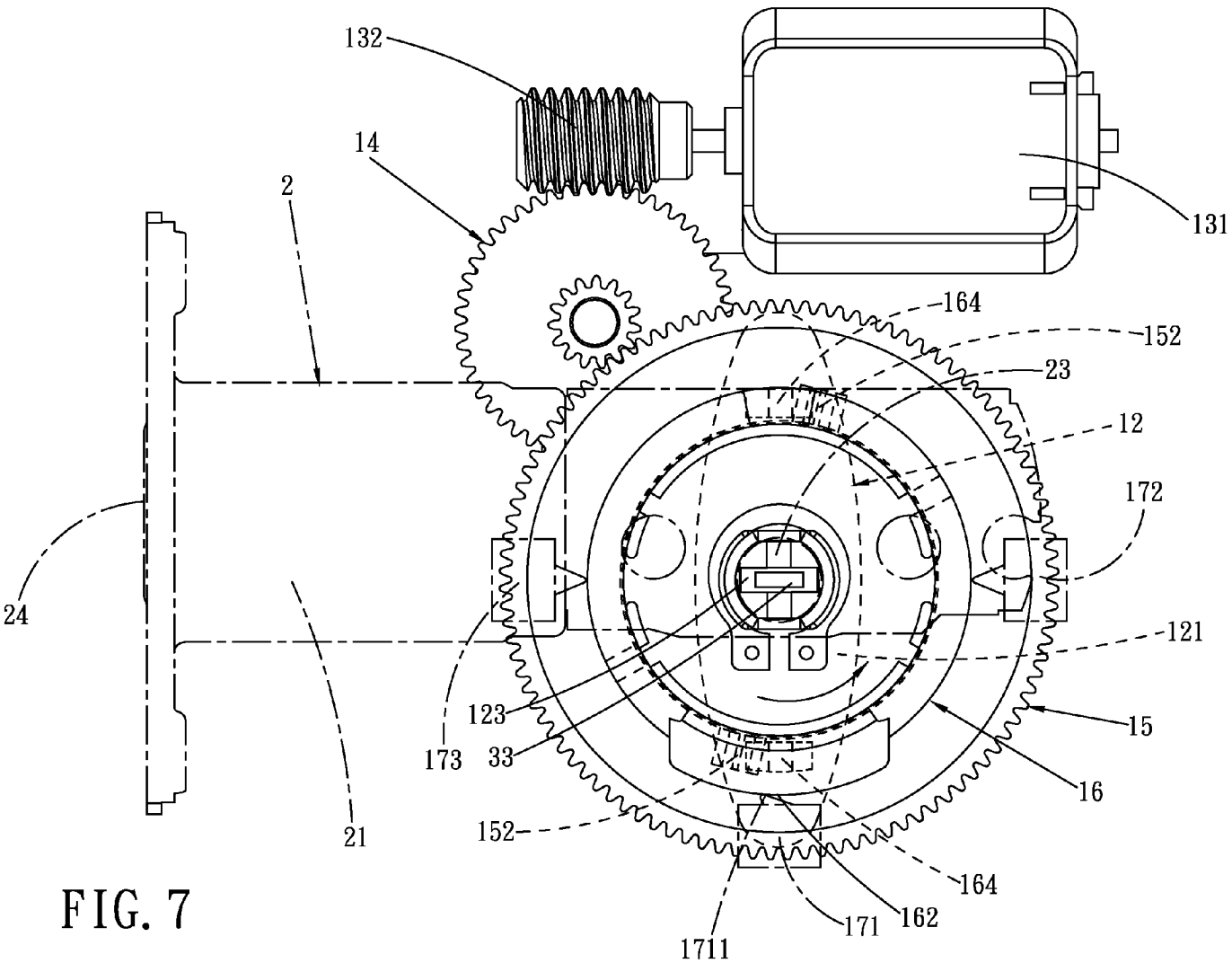
FIG. 7 is a plane schematic diagram partly showing the internal lock housing disposed in position on a right-hand door, which is an electronically operated to an unlocked position according to the preferred embodiment of the present invention.
Figure 8:
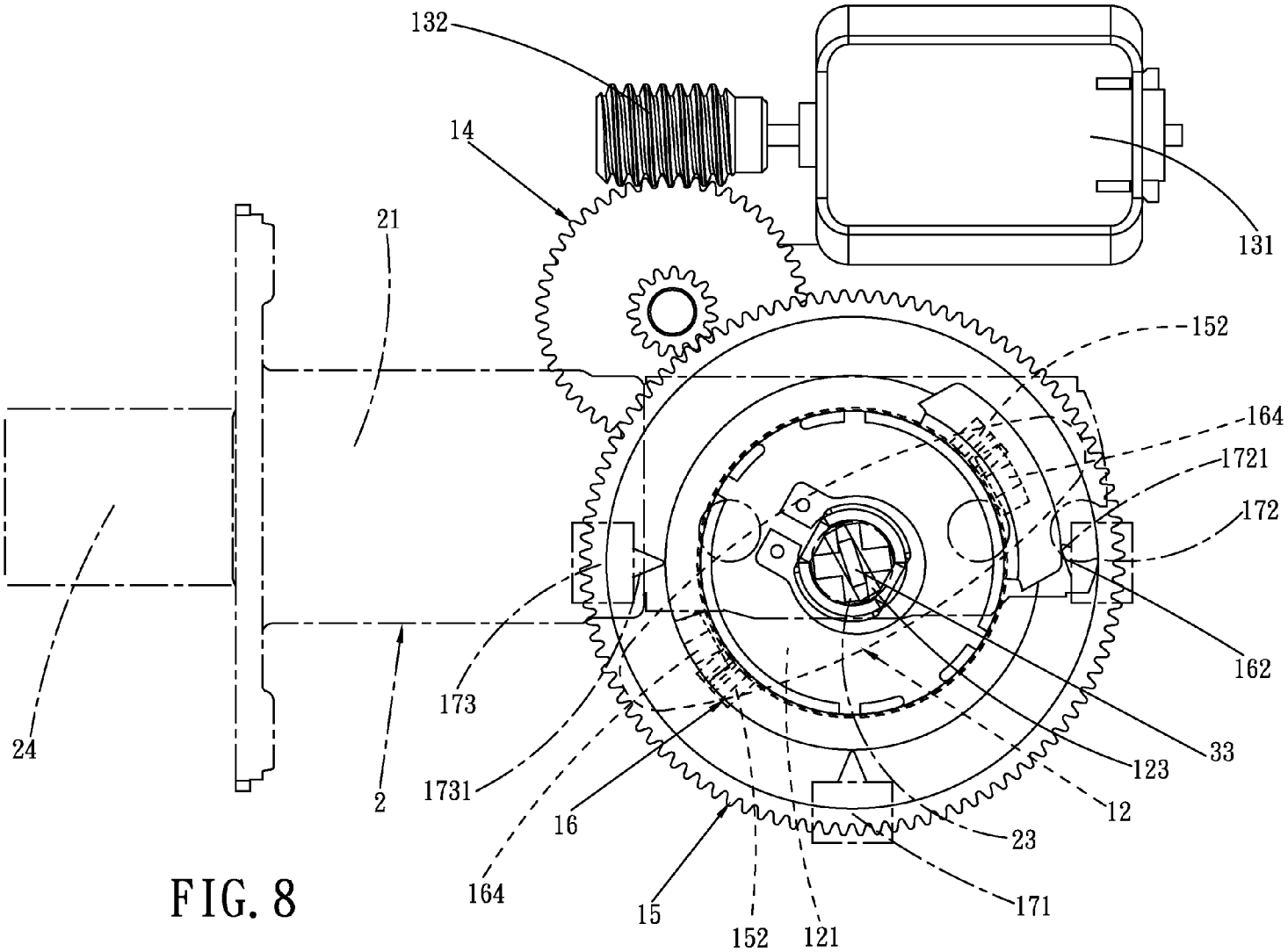
FIG. 8 is a plane schematic diagram partly showing the internal lock housing disposed in position on a right-hand door, which is an electronically operated to a locked position according to the preferred embodiment of the present invention.

Please refer to FIG. 1, FIG. 7 and FIG. 8, when the electric door lock 10 of this invention is assembled and secured into position on a right-hand door and the user wishes to electronically operate coupling plate 16 to move from the unlocked position (as in FIG. 7) to the locked position (as in FIG. 8), the electronic control component 34 is used to control the electronic control device 17, the motor 131 rotates the worm shaft 132, the said worm shaft 132 drives the worm wheel 14 which then drives cog wheel 15 to rotate counterclockwise so as to make the two bumps 152 on the cog wheel 15 respectively move close (as shown in FIG. 7) to the two bulges 164 (shown as a dotted line). The two bumps 152 on the cog wheel 15 respectively push the two bulges 164 on the coupling plate 16, thereby forcing coupling plate 16 to rotate counterclockwise. When the protruding part 162 of the coupling plate 16 touches the second sensor switch 172 and thus stops, it has to be noted that the motor 131 will continue to operate a while to let bump 152 on the cog wheel 15 pass over the bulge 164 of the coupling plate 16, which rotates to the locked position as shown in FIG. 8. This is to prevent interference caused when manually turning coupling plate 16 clockwise and the bump 152 on the cog wheel 15 meets with bulge 164 on the coupling plate 16, and also allows operating member 12 to maintain a power saving mode when operated manually. Owing to the different specifications of dead bolt 2 and the gap between the transmission shaft 33, the hole 23 and the recess 123 of the operating member 12, when making dead bolt head 24 move from the unlocked position to the locked position, it's necessary to rotate the operating member 12 and thereby coupling plate 16, approximately 90 to 120 degrees. Therefore, when the rotating protruding part 162 of the coupling plate 16 touches the touch control part 1721 of the second sensor switch 172 and thus stops, the motor 131 still drives the cog wheel 15 counterclockwise to rotate a short distance until the bump 152 on the cog wheel 15 passes over bulge 164 on coupling plate 16 and stops. And the protruding part 162 on the coupling plate 16 has to touch on the touch control part 1721 of the second sensor switch 172, so the width of the protruding part 162 on the coupling plate 16 needs to be set according to the specifications of dead bolt 2 and the gap between the transmission shaft 33, the hole 23 and recess 123 of the operating member 12. The set width of the protruding part 162 on the coupling plate 16 is angle C (see FIG. 3) which is formed by the two sides of the protruding part 162 on the coupling plate 16 to the axis of the coupling plate 16 is between 5 to 80 degrees (the invention angle is set at about 60 degrees). On the contrary, from the locked position to the unlocked position, all the actions are similar to the above mentioned but in the opposite direction, which will not be repeated again.

Figure 9:
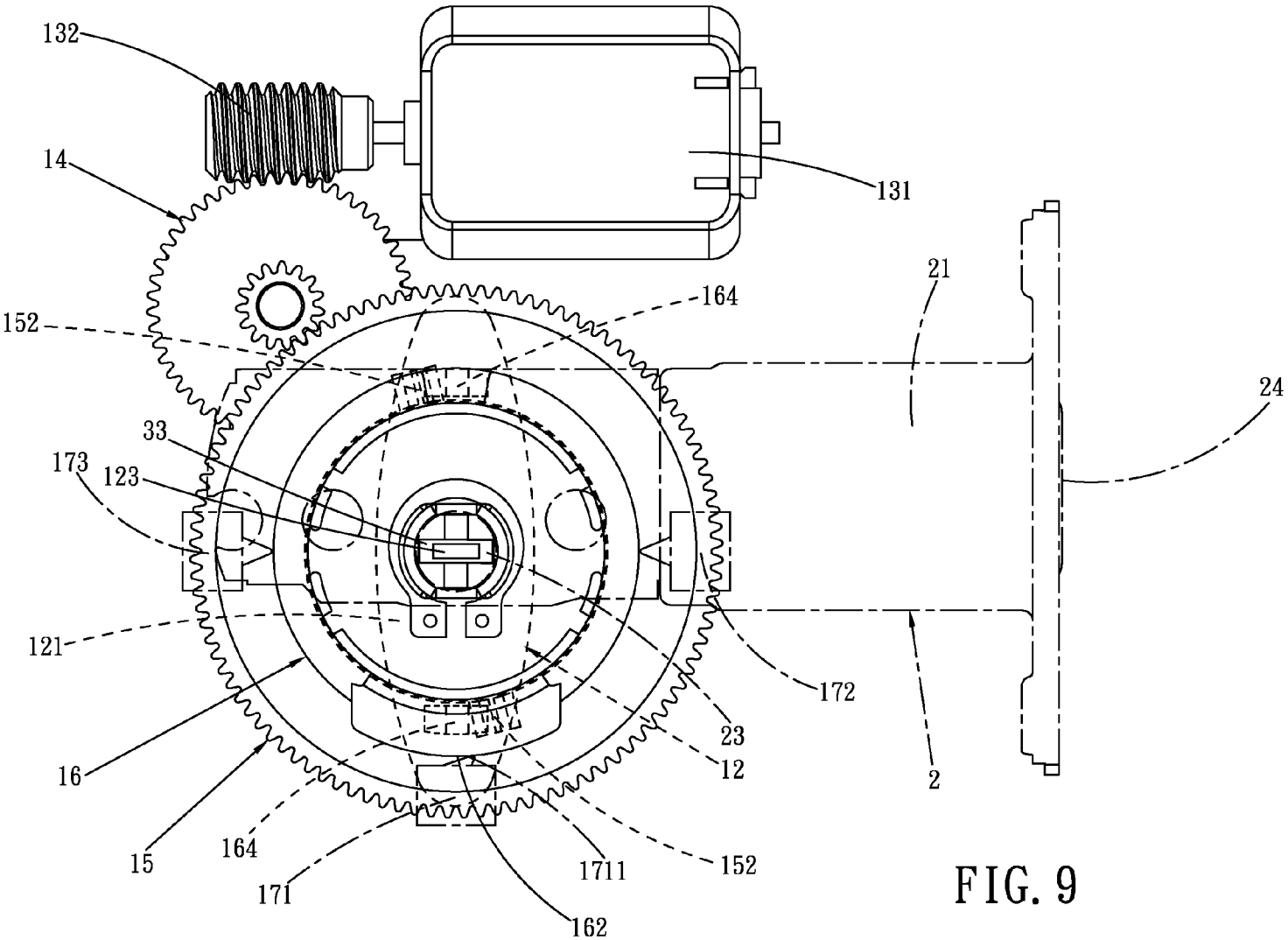
FIG. 9 is a plane schematic diagram partly showing the internal lock housing disposed in position on a left-hand door, which is electronically operated to an unlocked position according to the preferred embodiment of the present invention.
Figure 10:
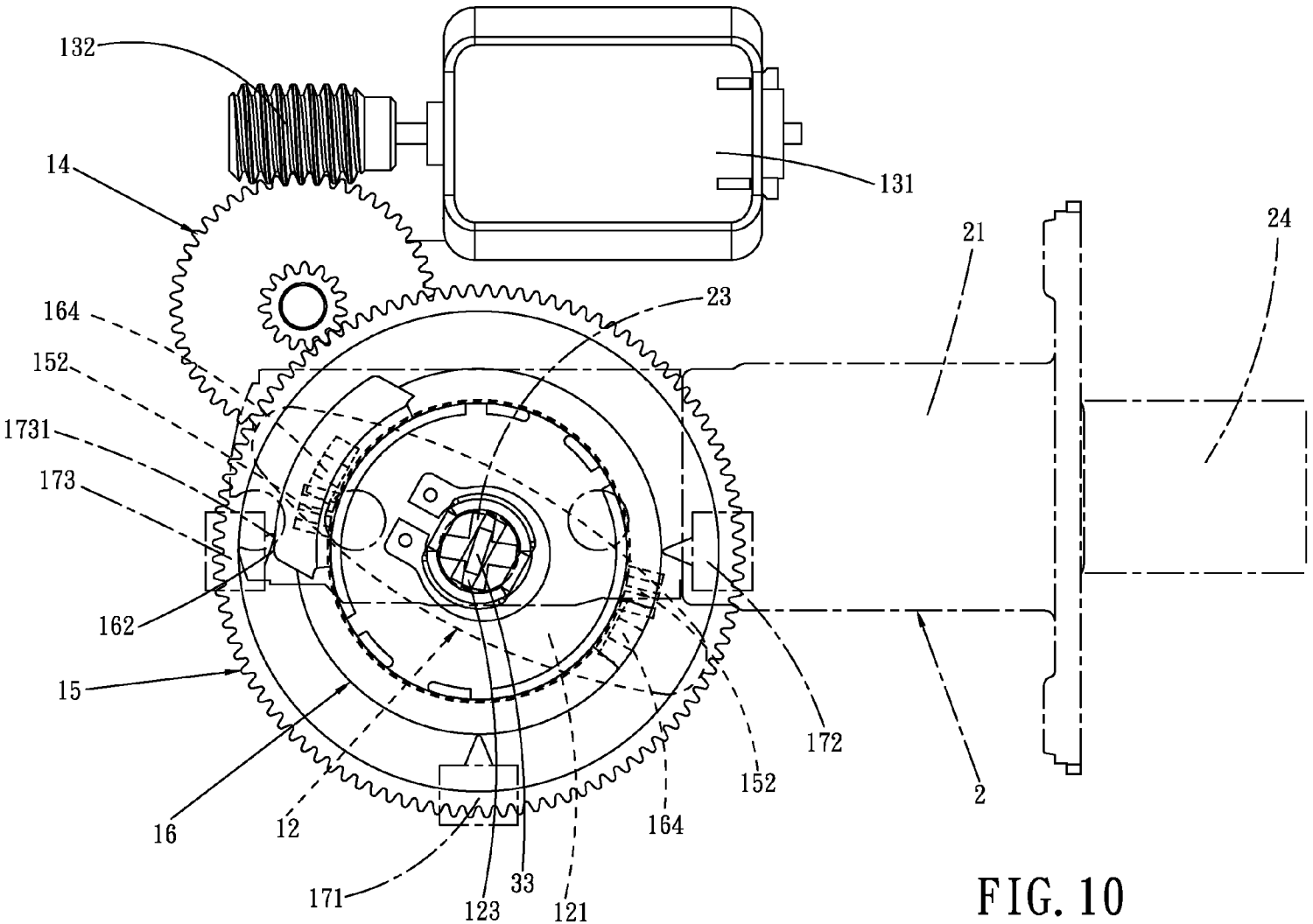
FIG. 10 is a plane schematic diagram partly showing the internal lock housing disposed in position on a left-hand door, which is electronically operated to a locked position according to the preferred embodiment of the present invention.

As shown in FIG. 9 and FIG. 10, the electric door lock is assembled and secured into position on a left-hand door or a right-hand door. Electronic control device 17 of the electric door lock 10 will automatically detect the direction of dead bolt head 24 of the dead bolt 2 at any particular moment, thereby automatically adjusting protruding part 162 of the coupling plate 16 to switch the touch control part 1711 of the first sensor switch 171 to an unlocked position and switch the touch control part 1731 of the third sensor switch 173 to a locked position. The transmission mode and operating procedures are the same as the aforementioned, which will not be reiterated again.

From the above description, according to the position in which the door and thus the electric door lock 10 is installed, protruding part 162 of the coupling plate 16 of this invention can switch the touch control part 1711 of the first sensor switch 171 and the touch control part 1721 of the second sensor switch 172 if the door is right opening and switch the touch control part 1731 of the third sensor switch 173 and the touch control part 1711 of the first sensor switch 171 if the door is left opening.

The angle between the first junction 167 and the second junction 168 which join plate 160 of the coupling plate 16 and the ringed part 165 in the invention can be adjusted to allow for different flexibility in bulges 164 of the ringed part 165. This is set according to the first junctions 167 in the manufacturing process, whereby a greater angle between second junctions 168 and first junctions 167 causes reduced flexibility in bulges 164 of the ringed part 165, and a lesser angle will cause increased flexibility.

Figure 11:
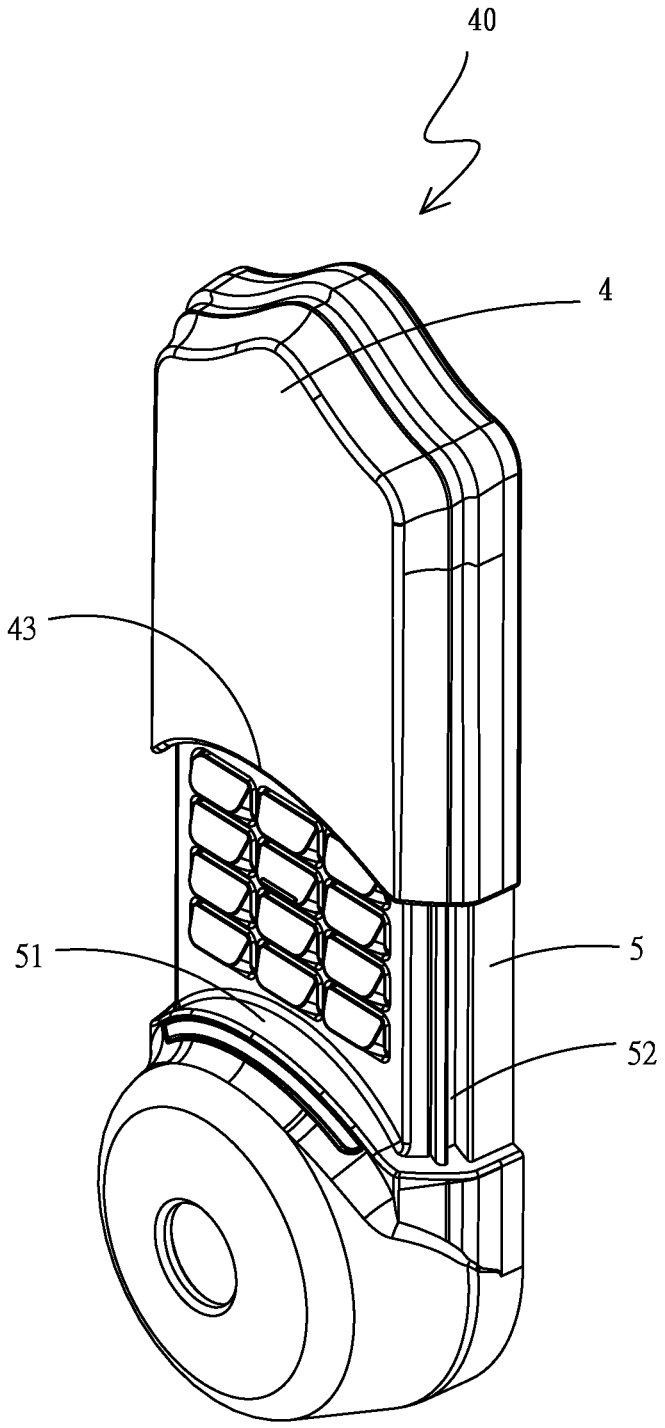
FIG. 11 is a perspective assembly diagram showing the sliding cover in the first position after the installation of the invention, which is the preferred embodiment of the lock sliding cover mechanism of the invention.
Figure 19:
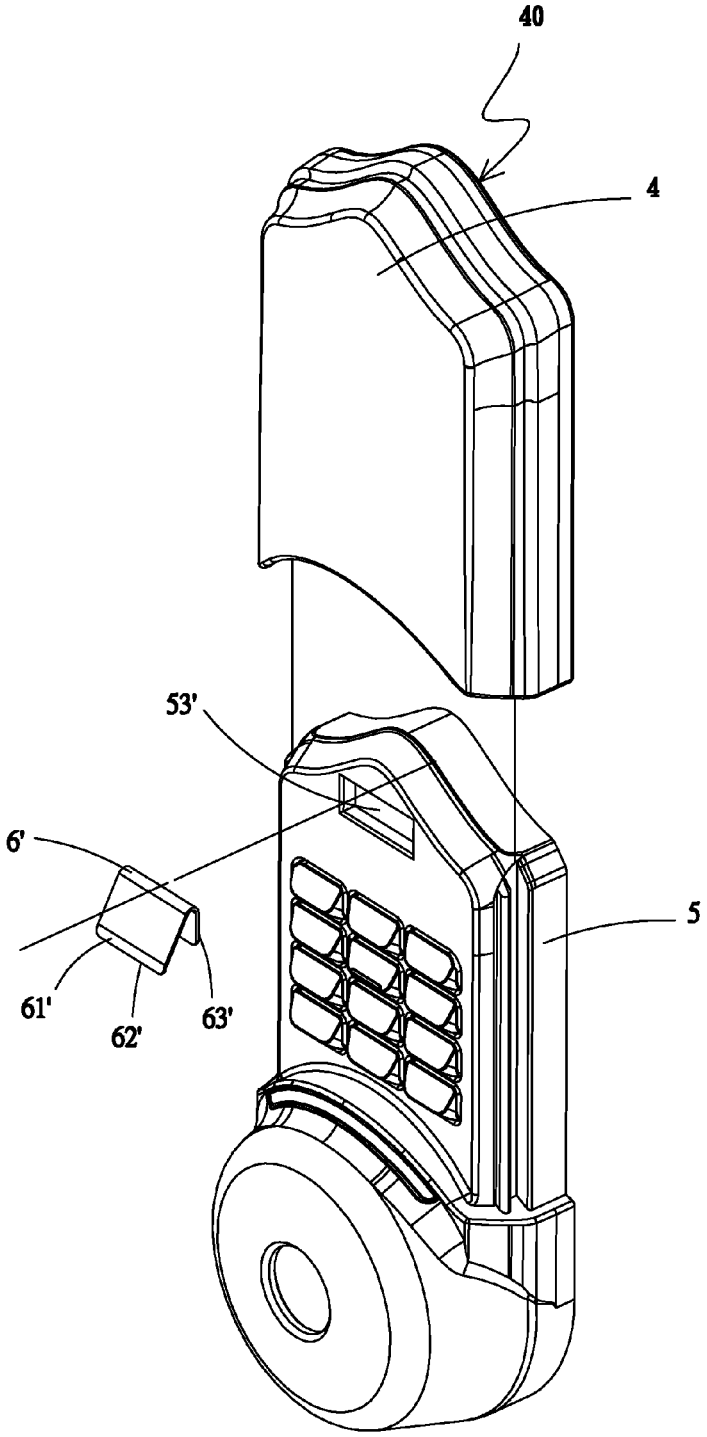
FIG. 19 is a perspective exploded diagram showing the sliding cover, decorative cover, and flexible element in the lock sliding cover mechanism of the preferred embodiment of the invention.

Please refer to FIG. 11 through to FIG. 19, the described external door housing 3, said external door housing 3 has one side with a lock sliding cover mechanism 40, said sliding cover mechanism 40 having a sliding cover 4, the sliding cover 4 having an inner surface 41, a first side 43 and a slide rail 44. On the center of the inner surface 41 and formed adjacent and parallel to each other are two first protrusions 421, and two second protrusions 422, first protrusions 421 each having a side 423 and an engaging part 424, each said engaging part 424 having an angled side, each second protrusion having a blocking part 425, the engaging part 424 and the blocking part 425 forming an angle.

Figure 12:
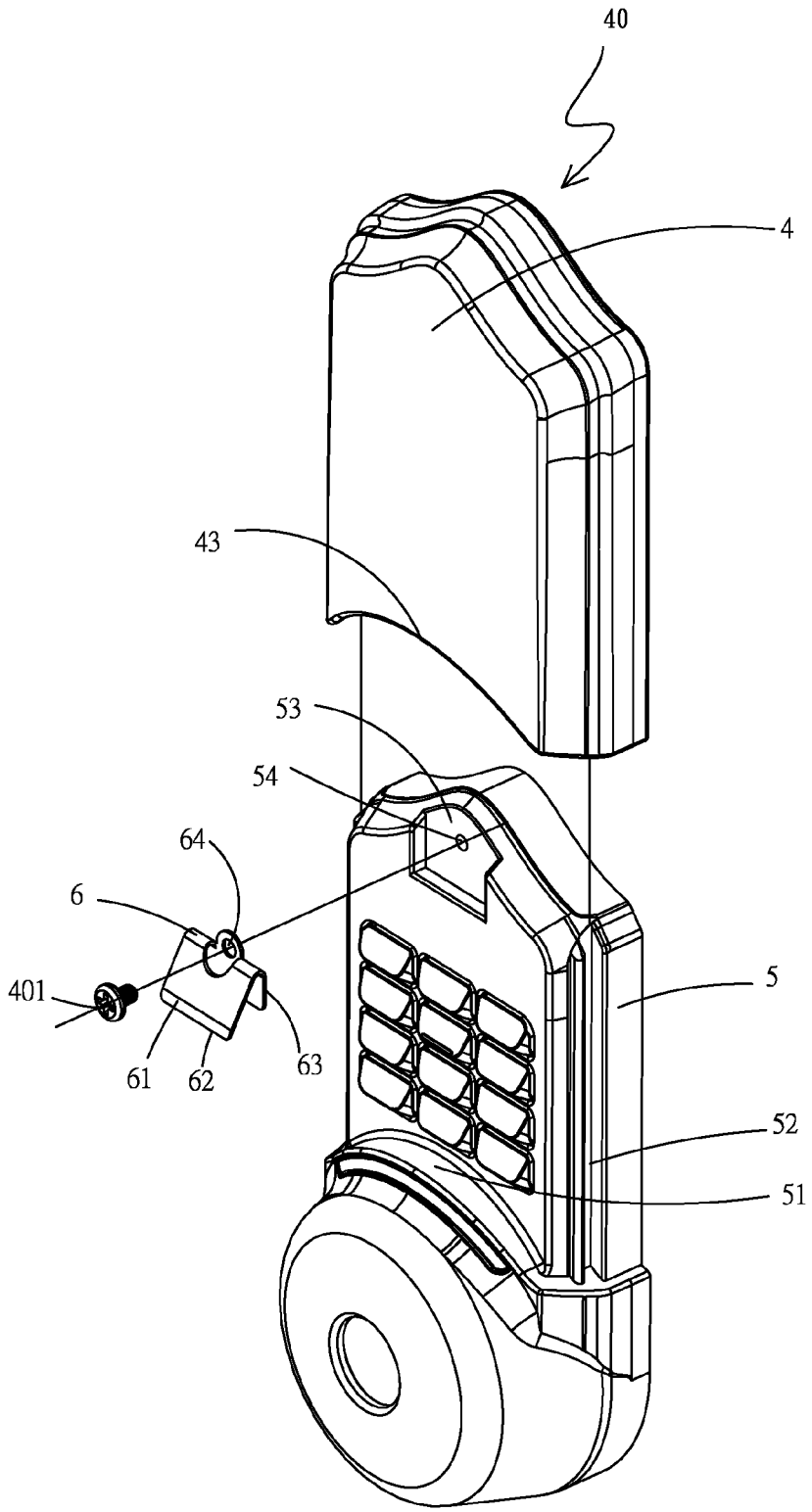
FIG. 12 is a perspective exploded diagram showing the sliding cover, the decorative cover, flexible element and the screw in the lock sliding cover mechanism of the preferred embodiment of the invention.

As shown in FIG. 12, the decorative cover 31 having a second side 51, a long groove 52 and a recess 53, the recess 53 having a hole 54 (the hole being a threaded hole).

As shown in FIG. 12, a flexible element 6 has a third side 61, a fourth side 63, an edge 62 and a hole 64. The third side 61 and the fourth side 63 are set to form an angle.

As shown in FIG. 12, a fixing element 401, said fixing element 401 is a screw. When installing, firstly the hole 64 of the flexible element 6 should align with hole 54 of recess 53 of the decorative cover 31 so as to make the fourth side 63 of the flexible element 6 be disposed on the recess 53 of the decorative cover 31. The fixing element 401 passes through the hole 64 of the flexible element 6 and then partially enters (or screws into) hole 54 of the decorative cover 31 so as to install flexible element 6 on the decorative cover 31.

Figure 18:
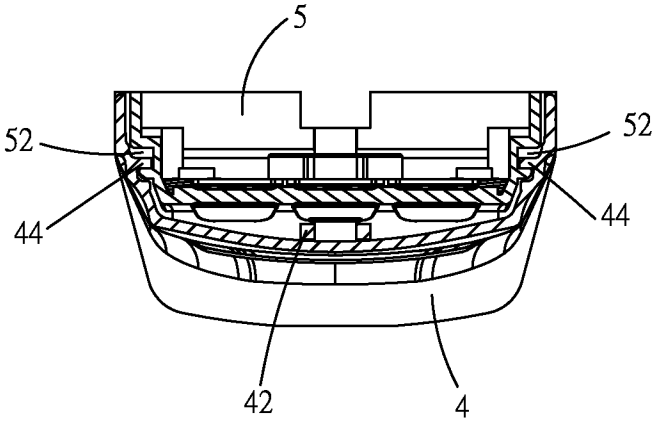
FIG. 18 is a sectional diagram of the section line 8-8 in FIG. 15 showing the lock sliding cover mechanism in the preferred embodiment of the invention.
Figure 17:
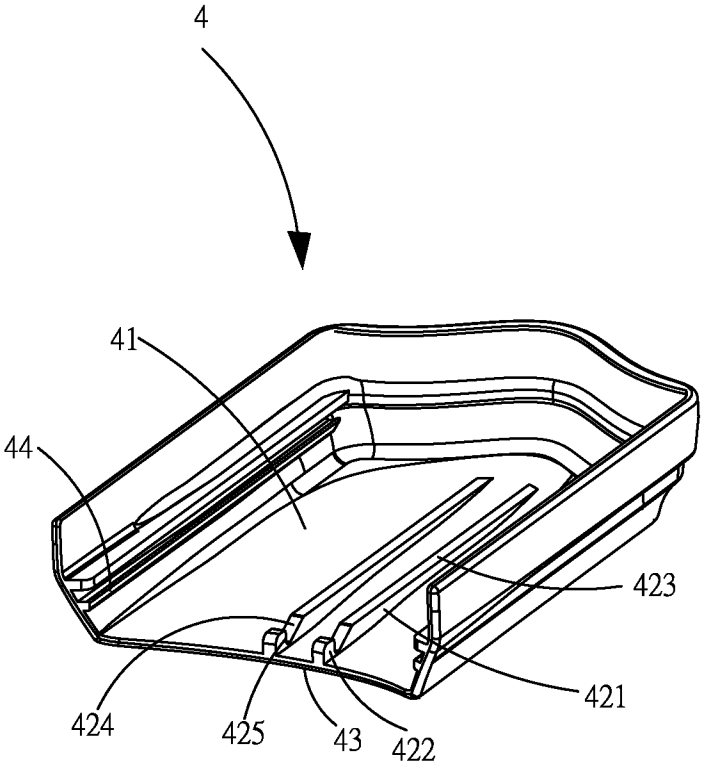
FIG. 17 is a perspective diagram showing the sliding cover in the lock sliding cover mechanism in the preferred embodiment of the invention.

As shown in FIG. 12, FIG. 17 and FIG. 18, when sliding cover 4 is installed on decorative cover 31, the sliding rail 44 of the sliding cover 4 is disposed inside the long groove 52 of the decorative cover 31 so as to allow sliding cover 4 to move between the first position and the second position on the decorative cover 31.

Figure 13:
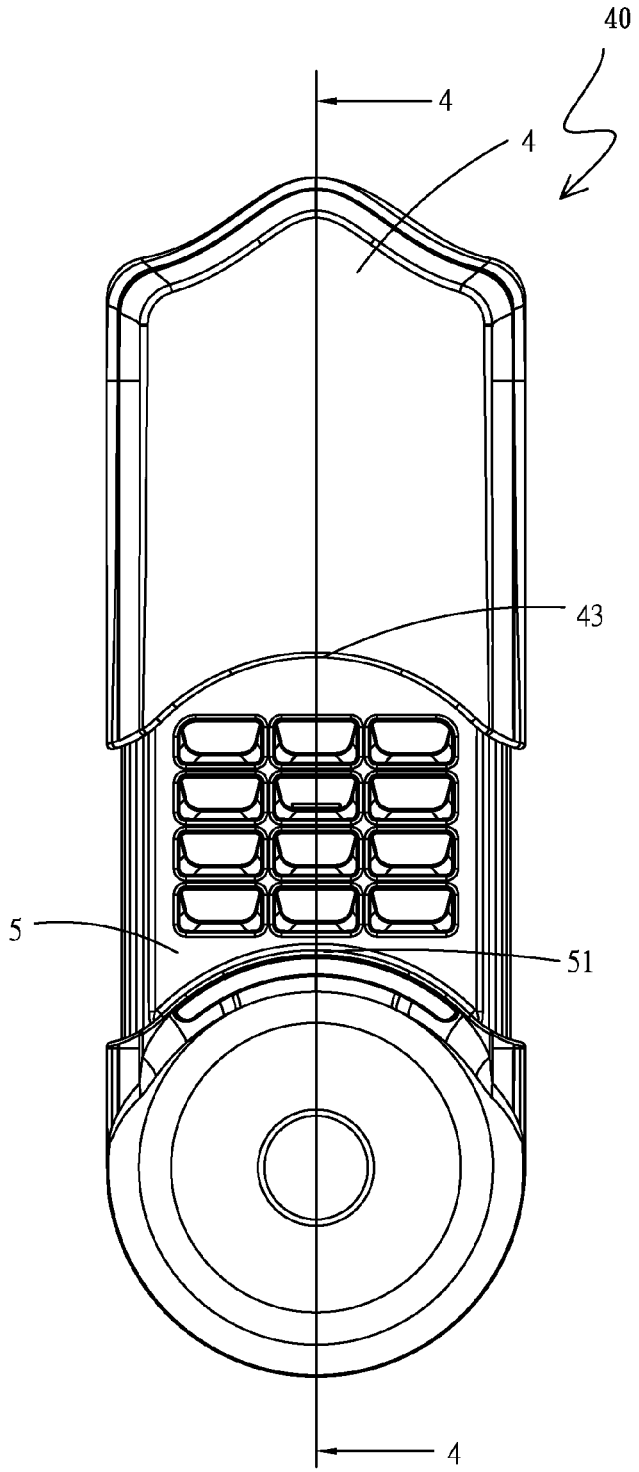
FIG. 13 is a plane schematic diagram showing the sliding cover in the first position after the installation of the invention, which is the preferred embodiment of the lock sliding cover mechanism of the invention.
Figure 14:
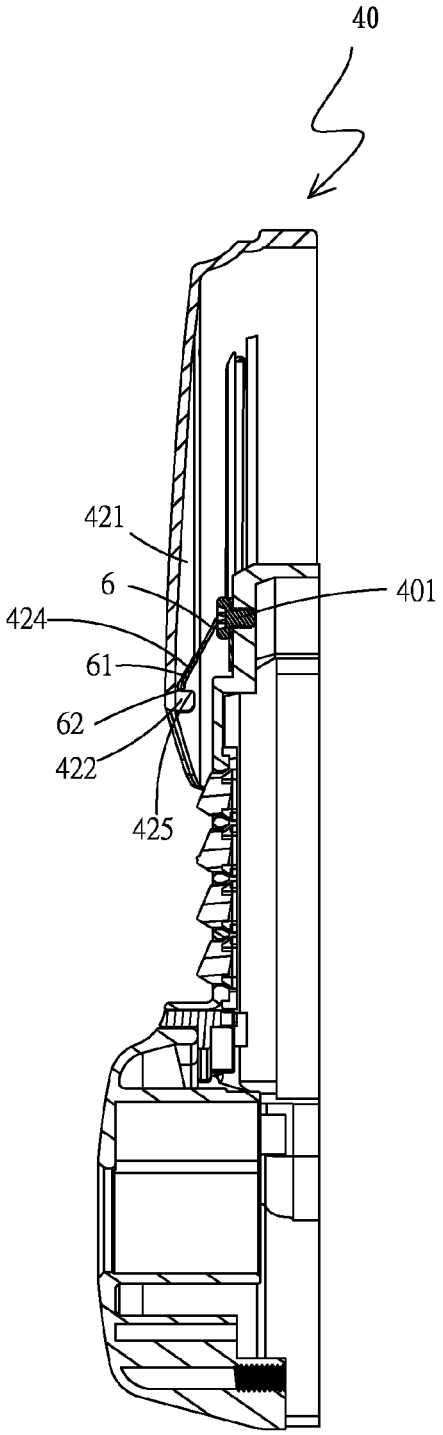
FIG. 14 is a sectional diagram of the section line 4-4 in FIG. 13 showing the lock sliding cover mechanism of the preferred embodiment of the invention.

As shown in FIG. 13 and FIG. 14, when the sliding cover 4 is at the first position, the first side 43 of the sliding cover 4 is not adjacent to the second side 51 of the decorative cover 31. The third side 61 of the flexible element 6 exerts a pushing force thereby holding engaging part 424 of the sliding cover 4. The edge 62 of flexible element 6 is close to the blocking part 425 of the sliding cover 4 so as to stop the sliding cover 4 from continuously moving upwards, and avoid exceeding the first position, thereby achieving a holding capability.

Figure 15:
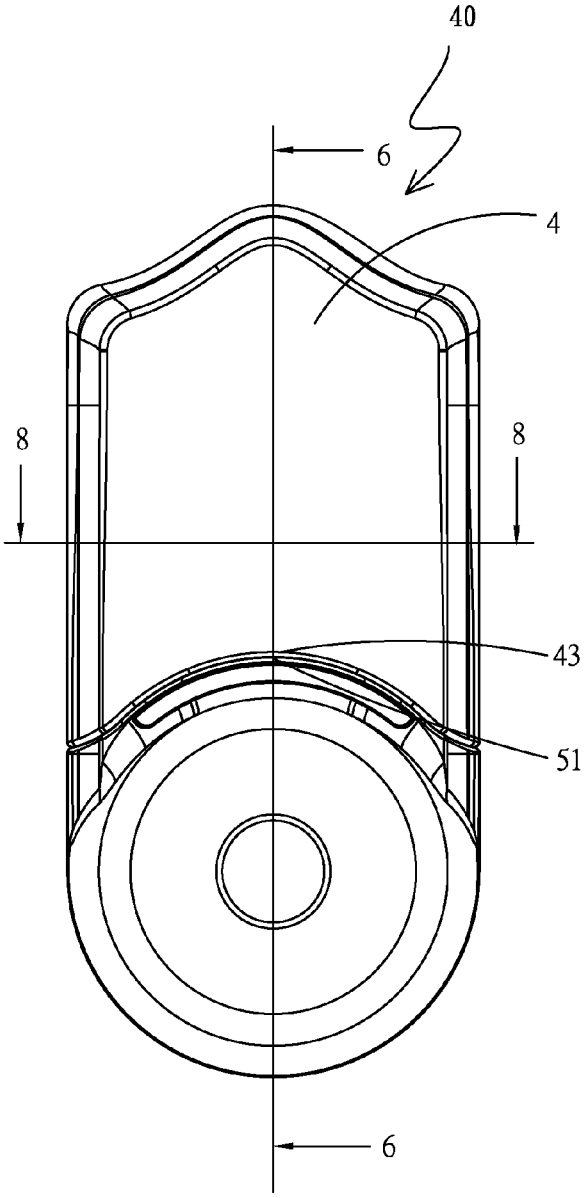
FIG. 15 is a plane schematic diagram showing the sliding cover in the second position after the installation of the invention, which is the preferred embodiment of the lock sliding cover mechanism of the invention.
Figure 16:
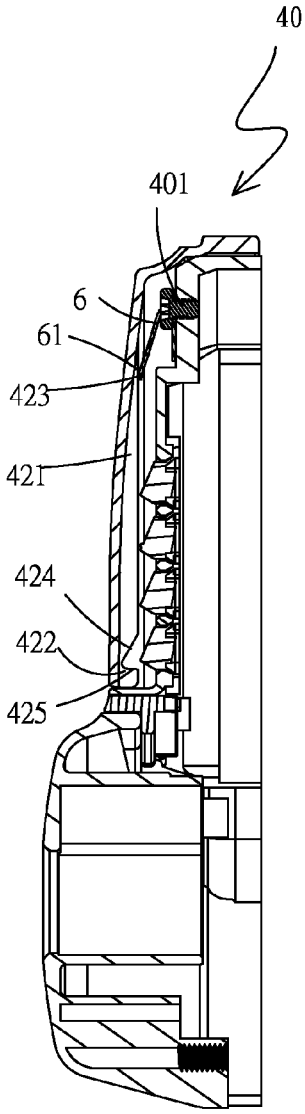
FIG. 16 is a sectional diagram of the section line 6-6 in FIG. 15 showing the lock sliding cover mechanism of the preferred embodiment of the invention.

As shown in FIG. 15 and FIG. 16, when the sliding cover 4 is at the second position, the first side 43 of the sliding cover 4 comes into contact with the second side 51 of the decorative cover 31. The third side 61 of flexible element 6 exerts a pushing force on side 423 of sliding cover 4, thereby preventing sliding cover 4 from freely moving.

Aforementioned flexible element 6 is installed in recess 53 of the decorative cover 31 by the fixing element 401, which can be modified as shown in FIG. 19, where a recess 53' is a rectangular recessed section on the decorative cover 31, flexible element 6' can be directly installed in the recess 53', the flexible element 6' having a third side 61' and a fourth side 63'. The fourth side 63' of the flexible element 6' is installed in the recess 53'. An angle between the third sides 61' and fourth sides 63' of the flexible element 6' can make the third side 61' extend out of the recess 53'. The flexible element 6' also has an edge 62' which can achieve the same effect as the above, and as the operation and structure is the same as the above, it won't be repeated again.

Figure 20:
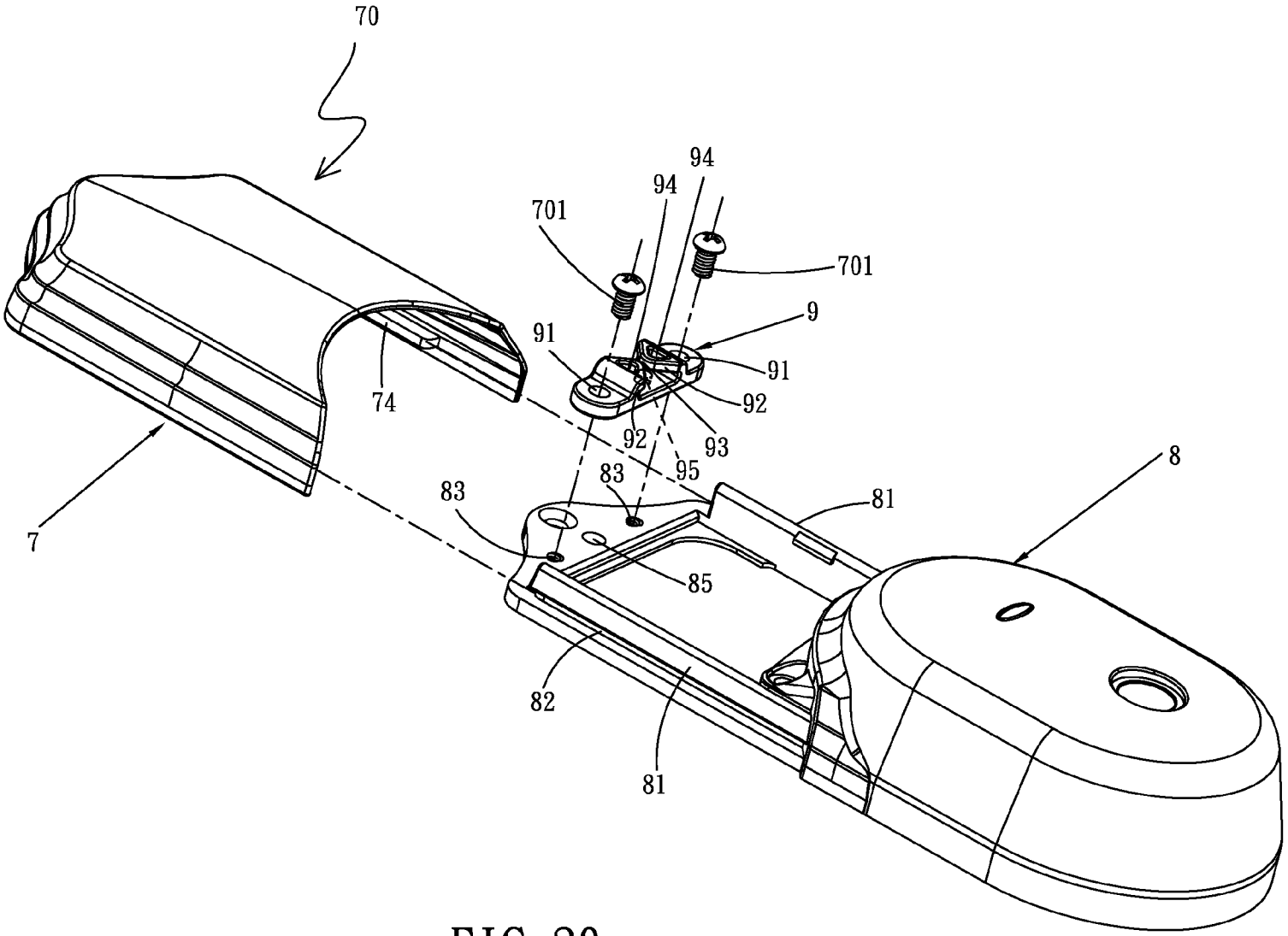
FIG. 20 is a perspective diagram showing the combination of the external cover, lock housing, engaging component and two screws in the preferred embodiment of the invention.
Figure 21:
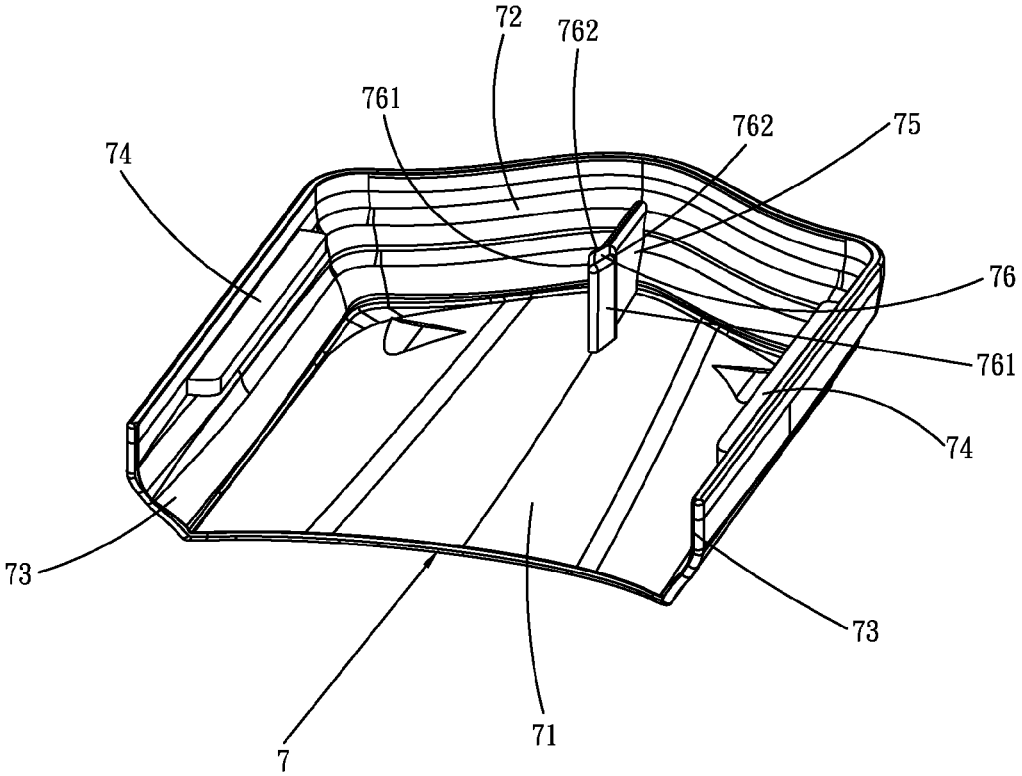
FIG. 21 is the perspective diagram showing the external cover of the preferred embodiment of the invention.
Figure 25:
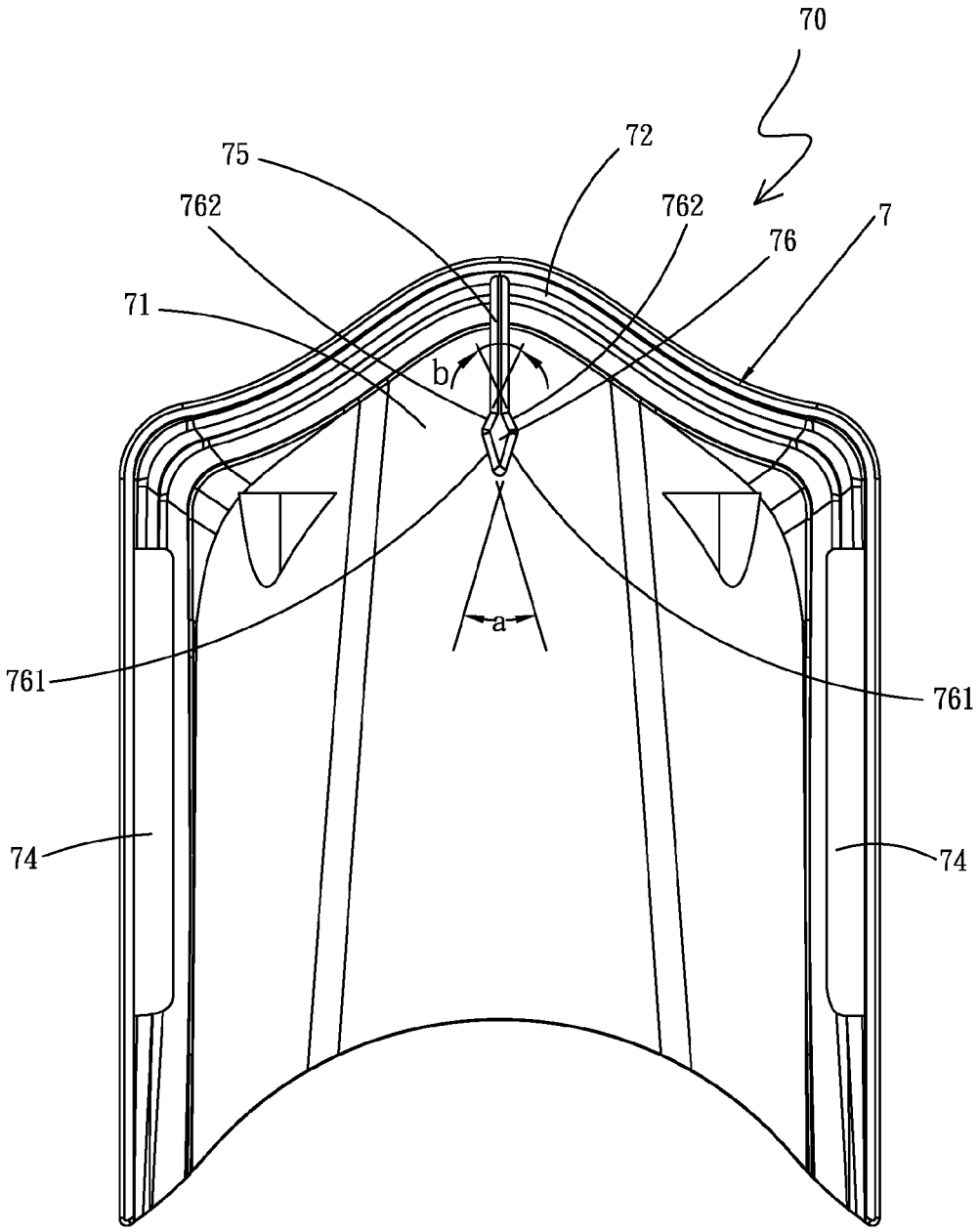
FIG. 25 is a plane diagram showing the external cover in the preferred embodiment of the invention.

Please refer to FIG. 20 through to FIG. 25, the internal lock housing 1 having an external cover positioning mechanism 70, the external cover positioning mechanism 70 having an external cover 7, the external cover having an inner surface 71. A first side 72 and two second sides 73 set apart are disposed around the edge of the inner surface 71. On the two second sides 73 are formed the respective slide rails 74. A protrusion 75 is formed on the inner surface 71 and the first side 72. One end of the protrusion 75 has an engaging element 76, which respectively forms two first guiding sides 761 set apart and two second guiding sides 762 set apart. Wherein, the first guiding sides 761 are connected to the second guiding sides 762, and the angle "a" formed by the two first guiding sides 761 is smaller than the angle "b" formed by the two second guiding sides 762.

Figure 22:
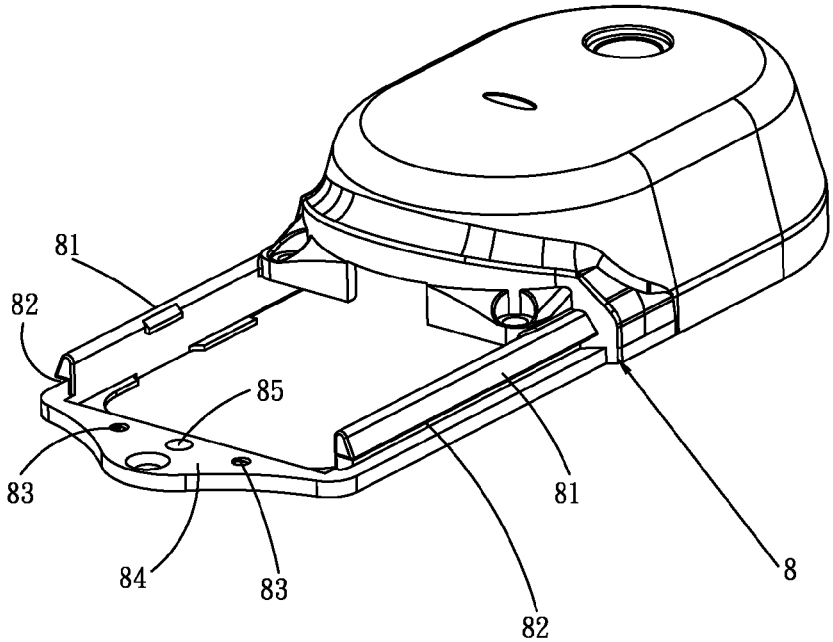
FIG. 22 is a perspective diagram showing the lock housing in the preferred embodiment of the invention.

As shown in FIG. 20 and FIG. 22, the lock housing 11 additionally has a lower side 84 and two sides 81 set apart. The two sides 81 form the respective grooves 82. The bottom side 84 forms two separate screw holes 83 and another hole 85.

Figure 23:
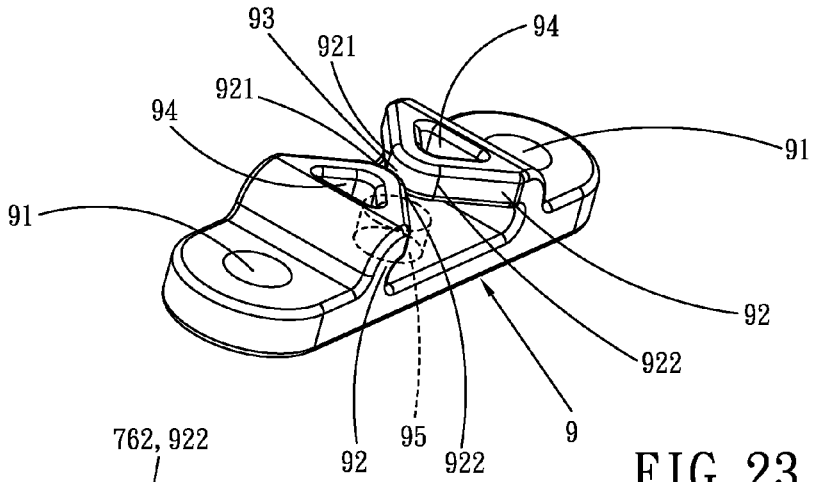
FIG. 23 is a perspective diagram showing the engaging element in the preferred embodiment of the invention.

As shown in FIG. 20 and FIG. 23, an engaging element 9 has two holes 91 and two extensions 92 set separately. The two extensions 92 respectively have a second guiding side 921 and a fourth guiding side 922, and a groove 93 formed between the two extensions 92, and the two extensions 92 having hollow interiors 94 to increase the flexibility of the second guiding sides 921 and the fourth guiding side 922. A knob 95 is set on the other side relative to the two extensions 92 of the engaging component 9.

As shown in FIG. 1 and FIG. 20-22, the knob 95 of the engaging component 9 can be inserted in hole 85 of the lock housing 11, then two screws 701 respectively penetrate the two holes 91 of the engaging component 9 and screw into the two screw holes 83 of the lock housing 11 so as to firmly secure the engaging component 9 on the lock housing 11.

Figure 24:
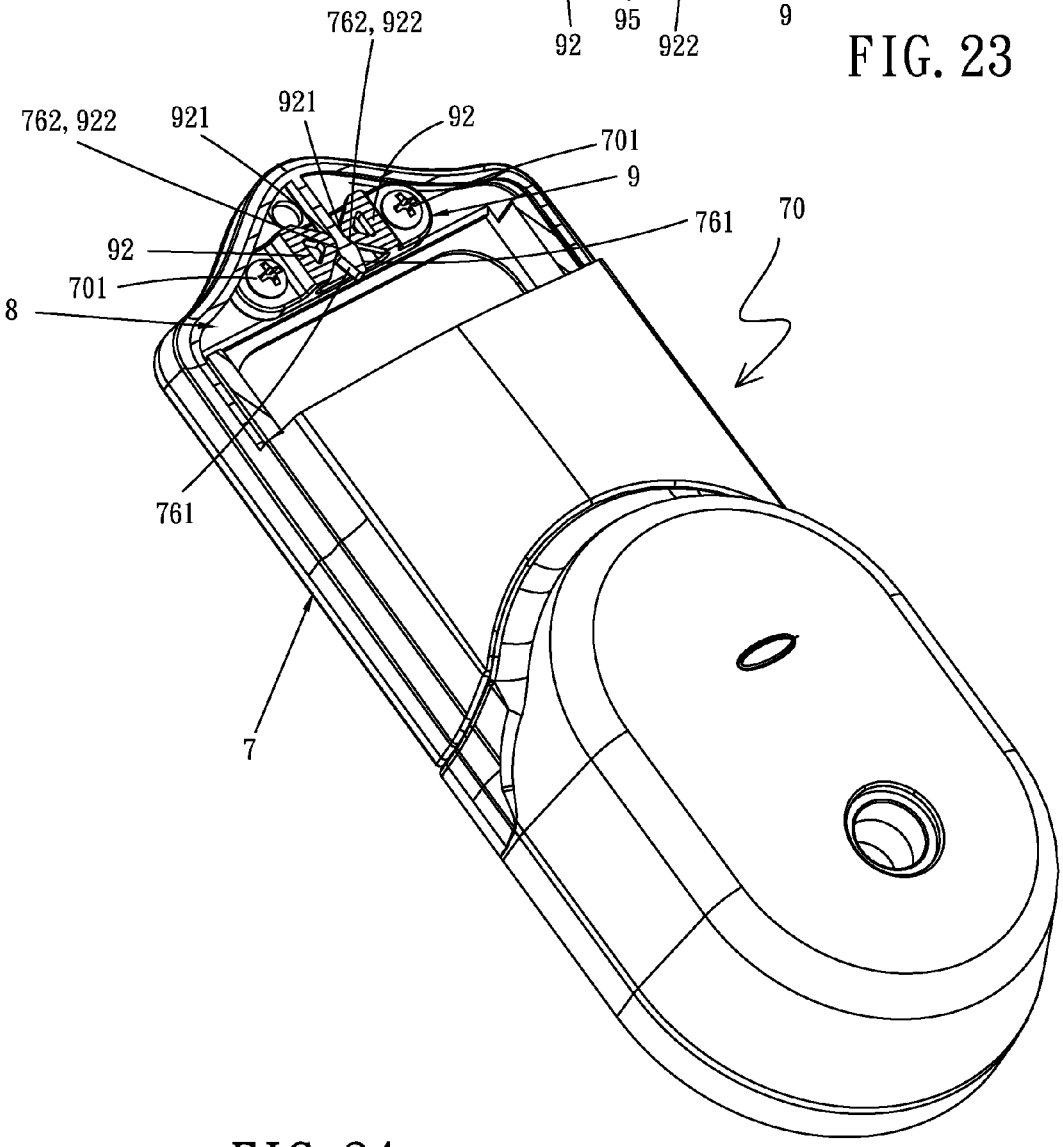
FIG. 24 is a partial perspective sectional diagram showing the combination of the external cover, lock housing, engaging component and two screws in the preferred embodiment of the invention.

As shown in FIG. 20 through to FIG. 24, when external cover 7 is installed on the housing 11, the slide rail 74 of the external cover 7 slides along the groove 82 of the lock housing 11. Pulling down on external cover 7 will push the slide rail 74 of the external 7 along the groove 82 of the lock housing 11. At the same time, the two first guiding sides 761 of the engaging element 76 of the external cover 7 will respectively slide through the two guiding sides 921 of the engaging component 9 of the lock housing 11 so as to make the engaging element 76 of the external cover 7 pass through groove 93 of the engaging component 9 and thereby ensuring the two third guiding sides 762 of the external cover 7 slide through the fourth guiding sides 922 of the engaging component 9. In this way, the external cover 7 is well installed on the lock housing 11.

As shown in FIG. 20 and FIG. 23, if the external cover 7 needs to be withdrawn from the lock housing, pushing the external cover 7 in the opposite direction to the above will make the two third guiding sides 762 of the engaging element 76 of the external cover 7 slide out the fourth guiding sides 922 of the engaging component 9 of the lock housing, thereby making the engaging element 76 of the external cover 7 pass through groove 93 of the engaging component 9. Slide rail 74 of the external cover 7 can therefore be removed from the groove 82, and thus removed from lock housing 11.

As shown in FIG. 25, as the angle formed by two first guiding sides 761 of the engaging element 76 of the external cover 7 is smaller than the angle formed by the two third guiding sides 762, when installing external cover 7 on the lock housing 11 less power is needed, and when removing external cover 7 from the lock housing 11, more power is needed, which makes external cover 7 attach in a more stable way on lock housing 11.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An electric door lock, comprising:

a lock housing;

an operating member having a holding part and a shaft part, the shaft part partially disposed in the lock housing, the shaft part connecting to the holding part, the holding part defined as having a long axis;

a motor placed in the lock housing, having a worm shaft in a front part thereof, which can drive a worm wheel to drive a cog wheel, the cog wheel having at least one bump;

a coupling plate set on the shaft part of the operating member, the coupling plate having at least one bulge and one protruding part, with the protruding part and the long axis of the holding part designed to move in alignment with each other; and three sensor switches set separately in the lock housing, wherein, operating the motor causes the at least one bump of the cog wheel to rotate and push the at least one bulge on the coupling plate, so that the protruding part of the coupling plate of the electric door lock installed in a required position on a left-hand door or a right-hand door, selectively touches two adjacent sensor switches, so as to reach a correct unlocked position or locked position, and wherein the coupling plate has a plate, a ringed part and an arc part, at least one first junction connecting the plate and the ringed part, the lock housing having an arc shaped groove, the arc part of the coupling plate being able to rotate in the arc shaped groove of the lock housing, the lock housing having a first flange and a second flange, between the first flange and the second flange being the arc shaped groove and an extension, at least one blocking surface being formed on the extension, at least one stopper being formed on the arc part of the coupling plate, the at least one blocking surface and the at least one stopper being able to limit a turning angle of the coupling plate.

2. The electric door lock of claim 1, wherein the at least one bump of the cog wheel has a surface being an arc-shaped surface, and the at least one bulge of the coupling plate has a surface being an arc-shaped surface.

3. The electric door lock of claim 1, wherein the three sensor switches respectively have a touch control part, the protruding part of the coupling plate is able to selectively touch the touch control part of any one of the three sensor switches as required.

4. The electric door lock of claim 1, wherein the coupling plate has two first junctions which join the plate and the ringed part, and the two first junctions set on a diameter line opposite each other.

5. The electric door lock of claim 1, which further comprises a lock sliding cover mechanism, the lock sliding cover mechanism comprising:

a decorative cover;

a sliding cover having at least one engaging part; and a flexible element having a third side, and the flexible element installed on the decorative cover, wherein, the sliding cover has at least one blocking surface, and the flexible element having an edge, when the sliding cover is at a first position, the third side of the flexible element is close to the at least one engaging part of the sliding cover; when the sliding cover is at a second position, the third side of the flexible element is away from the at least one engaging part of the sliding cover, when the sliding cover is at the first position, the edge of the flexible element is close to the at least one blocking surface of the sliding cover; when the sliding cover is at the second position, the edge of the flexible element is away from the at least one blocking surface of the sliding cover, the sliding cover having at least one first protrusion, the at least one first protrusion forming the at least one engaging part.

6. The electric door lock of claim 1, which further comprises an external cover positioning mechanism, the external cover positioning mechanism comprising:

an external cover having an engaging element, the engaging element having two first guiding sides, and an engaging component installed in the lock housing, the engaging component having two second guiding sides and a groove; the external cover having two third guiding sides, the engaging component having two fourth guiding sides, when the engaging element of the external cover passes through the groove of the engaging component, the two third guiding sides of the engaging element respectively are close to the two fourth guiding sides of the engaging component;

when the external cover is installed on the lock housing, the two first guiding sides of the engaging element respectively pass through the two second guiding sides of the engaging component so as to fasten the engaging element of the external cover into the groove of the engaging component.

7. The electric door lock of claim 6, wherein the engaging component has at least one knob, the lock housing has at least one hole, the at least one knob of the engaging component is set in the at least one hole in the lock housing.

8. An electric door lock, comprising:

a lock housing, having an arc shaped groove;

an operating member partially set in the lock housing;

a motor set in the lock housing, the motor having a worm shaft in the front, the worm shaft able to drive a worm wheel, said worm wheel able to drive a cog wheel, the cog wheel having at least one bump;

a coupling plate set on the operating member, the coupling plate having at least one bulge, one arc part and one protruding part, the arc part set in the arc shaped groove, the arc part able to rotate in the arc shaped groove; and three sensor switches set separately in the lock housing, wherein, operating the motor causes the cog wheel to rotate and push the at least one bulge of the coupling plate to an angular position with assistance of the at least one bump inside the cog wheel, and at the angular position, the at least one bump further slides over the at least one bulge, and the protruding part of the coupling plate of the electric door lock, installed in the required position on a left-hand door or right-hand door, selectively touches two sensor switches adjacent to each other, so as to reach the correct unlocked position or locked position.

9. The electric door lock of claim 8, wherein the coupling plate has a plate and a ringed part, at least one first junction connecting the plate and the ringed part, the lock housing further having a first flange and a second flange, the arc shaped groove and an extension formed between the first flange and the second flange, and at least one blocking surface formed on the extension of the lock housing, at least one stopper formed on the coupling plate, the at least one blocking surface and the at least one stopper able to limit a turning angle of the coupling plate.

10. The electric door lock of claim 8, wherein the at least one bump of the cog wheel has a surface being an arc-shaped surface, and the at least one bulge of the coupling plate has a surface being an arc-shaped surface.

11. The electric door lock of claim 8, which further comprises a lock sliding cover mechanism, the lock sliding cover mechanism comprising:

a decorative cover;

a sliding cover having at least one engaging part; and a flexible element having a third side, wherein, the flexible element is installed on the decorative cover, wherein, the sliding cover has at least one blocking surface, the flexible element has an edge, when the sliding cover is at a first position, the edge of the flexible element is close to the at least one blocking surface of the sliding cover; when the sliding cover is at a second position, the edge of the flexible element is away from the at least one blocking surface of the sliding cover, the sliding cover having at least one first protrusion, the at least one first protrusion forming the at least one engaging part, when the sliding cover is at the first position, the third side of the flexible element is close to the at least one engaging part of the sliding cover; when the sliding cover is at the second position, the third side of the flexible element is away from the at least one engaging part of the sliding cover.

12. The electric door lock of claim 8, which further comprises an external cover positioning mechanism, the external cover positioning mechanism comprising:

an external cover having an engaging element, the engaging element having two first guiding sides; and an engaging component installed in the lock housing, the engaging component having two second guiding sides and a groove, when the external cover is installed on the lock housing, the two first guiding sides of the engaging element respectively slide along the two second guiding sides of the engaging component so as to set the engaging element of the external cover into the groove of the engaging component.

13. The electric door lock of claim 12, wherein the external cover has two third guiding sides, the engaging component has two fourth guiding sides, when the engaging element of the external cover passes through the groove of the engaging component, the two third guiding sides of the engaging element respectively are close to the two fourth guiding sides of the engaging component, the engaging component has a knob, the lock housing has a hole, and the knob of the engaging component is inserted into the hole in the lock housing.

14. An electric door lock, comprising:

a lock housing, having an arc shaped groove;

an operating member partially set in the lock housing;

a motor set in the lock housing, having a worm shaft in the front, being able to drive a worm wheel, said worm wheel driving a cog wheel, the cog wheel having at least one bump;

a coupling plate set on the operating member, the coupling plate having at least one bulge, one arc part and one protruding part, the arc part able to be set in the arc shaped groove and able to rotate in the arc shaped groove; and at least two sensor switches set separately in the lock housing, operating the motor causing the at least one bump of the cog wheel to rotate and push the at least one bulge of the coupling plate, so that the protruding part of the coupling plate is able to touch one sensor switch as required.

15. The electric door lock of claim 14, which further comprises a lock sliding cover mechanism, the lock sliding cover mechanism comprising:

a decorative cover;

a sliding cover having at least one engaging part; and a flexible element, having a third side;

wherein, the flexible element is installed on the decorative cover, wherein, the sliding cover has at least one blocking surface, the flexible element has an edge, when the sliding cover is at a first position, the edge of the flexible element is close to the at least one blocking surface of the sliding cover; when the sliding cover is at a second position, the edge of the flexible element is away from the at least one blocking surface of the sliding cover, the sliding cover having at least one first protrusion, the at least one first protrusion forming the at least one engaging part;

when the sliding cover is at the first position, the third side of the flexible element is close to the at least one engaging part of the sliding cover; when the sliding cover is at the second position, the third side of the flexible element is away from the at least one engaging part of the sliding cover.

16. The electric door lock of claim 14, further comprises an external cover positioning mechanism, the external cover positioning mechanism comprising:

an external cover having an engaging element, the engaging element having two first guiding sides, and an engaging component installed in the lock housing, the engaging component having two second guiding sides and a groove, wherein, the external cover has two third guiding sides, the engaging component has two fourth guiding sides, when the engaging element of the external cover passes through the groove of the engaging component, the two third guiding sides of the engaging element respectively are close to the two fourth guiding sides of the engaging component, and the engaging component has at least one knob, the lock housing has at least a hole, the at least one knob of the engaging component is set in the at least one hole of the lock housing, when the external cover is installed on the lock housing, the two first guiding sides of the engaging element respectively pass through the two second guiding sides of the engaging component so as to allow the engaging element of the external cover to pass through the groove of the engaging component.

* * * * *